US007797078B2

(12) United States Patent
Sakano

(10) Patent No.: US 7,797,078 B2
(45) Date of Patent: Sep. 14, 2010

(54) STICKY NOTE SUPPLY DEVICE AND STICKY NOTE PRINTER

(75) Inventor: Hideki Sakano, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 86 days.

(21) Appl. No.: 11/743,586

(22) Filed: May 2, 2007

(65) Prior Publication Data

US 2008/0018042 A1 Jan. 24, 2008

(30) Foreign Application Priority Data

Jul. 21, 2006 (JP) ..... 2006-199029

(51) Int. Cl.
*G06F 17/00* (2006.01)

(52) U.S. Cl. ..... 700/240; 700/232; 700/235; 221/7; 221/13; 221/36; 221/210; 271/10.03

(58) Field of Classification Search ..... 700/231–244; 221/1–312 C; 271/10.03
See application file for complete search history.

(56) References Cited

U.S. PATENT DOCUMENTS

| | | | | |
|---|---|---|---|---|
| 3,760,158 | A * | 9/1973 | Whitehead et al. | 221/9 |
| 4,891,088 | A * | 1/1990 | Svyatsky | 156/350 |
| 5,305,197 | A * | 4/1994 | Axler et al. | 705/14 |
| 6,527,462 | B2 * | 3/2003 | Arledge et al. | 400/103 |
| 6,971,806 | B2 * | 12/2005 | Wessells et al. | 400/48 |
| 7,744,297 | B2 * | 6/2010 | Nakajima | 400/76 |
| 2002/0030830 | A1 * | 3/2002 | Day et al. | 358/1.8 |
| 2002/0153290 | A1 * | 10/2002 | Otsuka | 209/534 |
| 2005/0145745 | A1 * | 7/2005 | Lewis et al. | 242/563 |
| 2005/0171634 | A1 * | 8/2005 | York et al. | 700/231 |

FOREIGN PATENT DOCUMENTS

| | | | |
|---|---|---|---|
| JP | 03026616 | A | 2/1991 |
| JP | 07306974 | A | 11/1995 |
| JP | 08183212 | A | 7/1996 |
| JP | 2000335030 | A | 12/2000 |
| JP | 2003-011436 | | 1/2003 |
| JP | 2003-011437 | | 1/2003 |
| JP | 2003-081455 | | 3/2003 |
| JP | 2003-081457 | | 3/2003 |
| JP | 2003-212367 | | 7/2003 |
| JP | 2006-175878 | | 7/2006 |

OTHER PUBLICATIONS

Japanese language office action for corresponding Japanese application 2006-199029 lists the references above.

* cited by examiner

*Primary Examiner*—Gene Crawford
*Assistant Examiner*—Michael K Collins
(74) *Attorney, Agent, or Firm*—Hogan Lovells US LLP

(57) ABSTRACT

There is provided a sticky note supply device that separates an uppermost sticky note from a stacks of sticky note one by one so as to discharge to the outside of the device from a discharge section. The sticky note supply device includes a transport unit that separates the sticky note to discharge the sticky note to the outside of the device from the discharge section, a control unit that controls the drive of the transport unit, and a detecting unit that is provided in the discharge section so as to detect whether the sticky note is present or not. When a next sticky note starts to be transported after the sticky note is completely transported by the transport unit and the detecting unit detects the presence, the control unit prohibits the transport unit from being driven.

6 Claims, 5 Drawing Sheets

STICKY NOTE SUPPLY DEVICE AND STICKY NOTE PRINTER

The entire disclosure of Japanese Patent Application No. 2006-199029, filed Jul. 21, 2006, is expressly incorporated by reference herein.

BACKGROUND

1. Technical Field

The present invention relates to a sticky note supply device and a sticky note printer which separate an uppermost sticky note from a stacks of sticky note one by one so as to supply the sticky note.

2. Related Art

Generally, as for a sticky note printer including this type of sticky note supply device, a sticky note printer has been known which separates a sticky note from a stacks of sticky note one by one, performs printing on the sticky note, and discharges the sticky note from a discharge slot formed in a device case toward the outside of the device (JP-A-2003-81455)

In the above-described structure, however, the separated sticky note is fed in a state where a pasting portion thereof is exposed. Therefore, when the sticky note is completely transported, the exposed pasting portion thereof is frequently attached around the discharge slot without falling down from the discharge slot. At this time, when the next printing process is performed in a state where the sticky note has not removed by a user (or the user failed to remove), a plurality of sticky notes overlap in the discharge slot such that a paper jam can occur.

SUMMARY

An advantage of some aspects of the invention is that it provides a sticky note supply device and a sticky note printer which can reliably prevent sticky notes from being jammed in a discharge section.

According to an aspect of the invention, there is provided a sticky note supply device that separates an uppermost sticky note from a stacks of sticky note one by one so as to discharge to the outside of the device from a discharge section. The sticky note supply device includes a transport unit that separates the sticky note to discharge the sticky note to the outside of the device from the discharge section, a control unit that controls the drive of the transport unit, and a detecting unit that is provided in the discharge section so as to detect whether the sticky note is present or not. When a next sticky note starts to be transported after the sticky note is completely transported by the transport unit and the detecting unit detects the presence, the control unit prohibits the transport unit from being driven.

According this structure, when the next sticky note starts to be transported, and when the detecting unit detects presence, the control unit determines that the sticky note is not removed from the discharge section, and prohibits the transport unit from being driven. Accordingly, since the next sticky note is not fed, a paper jam does not occur in the discharge section. As for the detecting unit, an optical sensor or a mechanical switch is preferably used.

Preferably, the sticky note supply device according to the aspect of the invention further includes a defective discharge informing unit that informs that defective discharge is performed, when the next sticky note starts to be transported after the sticky note is completely transported and the detecting unit detects the presence.

According to this structure, it is possible to remind a user that the defective discharge of sticky note is performed. Simultaneously, it is possible to inform a user that the sticky note needs to be removed. As for the informing method, character display, lamp display, and voice are considered.

According to another aspect of the invention, there is provided a sticky note supply device that separates the uppermost sticky note from a stacks of sticky note one by one so as to discharge to the outside of the device from a discharge section. The sticky note supply device includes a transport unit that separates the sticky note to discharge the sticky note to the outside of the device from the discharge section, a control unit that controls the drive of the transport unit, a detecting unit that is provided in the discharge section so as to detect whether the sticky note is present or not, and a counting unit that counts the presence detection of the detecting unit every time transport is completed, when a next sticky note starts to be transported after the sticky note is completely transported by the transport unit. When the counted number by the counting unit exceeds a predetermined number, the control unit prohibits the transport unit from being driven.

According to this structure, when the counted number exceeds a predetermined number, the control unit determines that the sticky note is not removed from the discharge section, and prohibits the transport unit from being driven. Accordingly, since the next sticky note is not fed into the discharge section, it is possible to prevent a paper jam. Meanwhile, when the counted number is within the predetermined number, it is assumed that a paper jam is unlikely to occur in the discharge section. Therefore, the discharge of the sticky note is permitted. Therefore, when sticky notes are consecutively printed, a sticky note to be discharged in sequence does not need to be prohibited from being transported in each case.

Preferably, the sticky note supply device according to another aspect of the invention further includes a discharge completion informing unit that informs the completion of discharge, when the detecting unit detects the presence after the sticky note is completely transported.

According to this structure, when the sticky note is completely transported, and when the detecting unit detects the presence of the sticky note, it is possible to remind a user that the sticky note is not removed and needs to be removed.

Preferably, the sticky note supply device according to another aspect of the invention further includes a defective discharge informing unit that informs that defective discharge is performed, when the counted number by the counting unit exceeds a predetermined number.

According to this structure, it is possible to remind a user that the defective discharge of the sticky note is performed.

According to a still another aspect of the invention, a sticky note printer includes the sticky note supply device and a printing unit that performs printing on a sticky note.

According to this structure, since it is detected that the sticky note is not removed, it is possible to reliably prevent a paper jam in the discharge section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a case where a sticky note supply device according to an embodiment of the present invention is assembled into a sticky note printer will be described with reference to the accompanying drawings. First, printing data is created by a PC. On the basis of the created printing data, the sticky note printing device of the sticky note printer rolls up the uppermost sticky note from a stacks of sticky note to be set and then performs printing while separating the rolled-up sticky note. Then, the sticky note printing device discharges the printed sticky note to the outside of the printer. That is, the sticky note printer is constructed as a system composed of the PC and the sticky note printing device.

Figure 1:
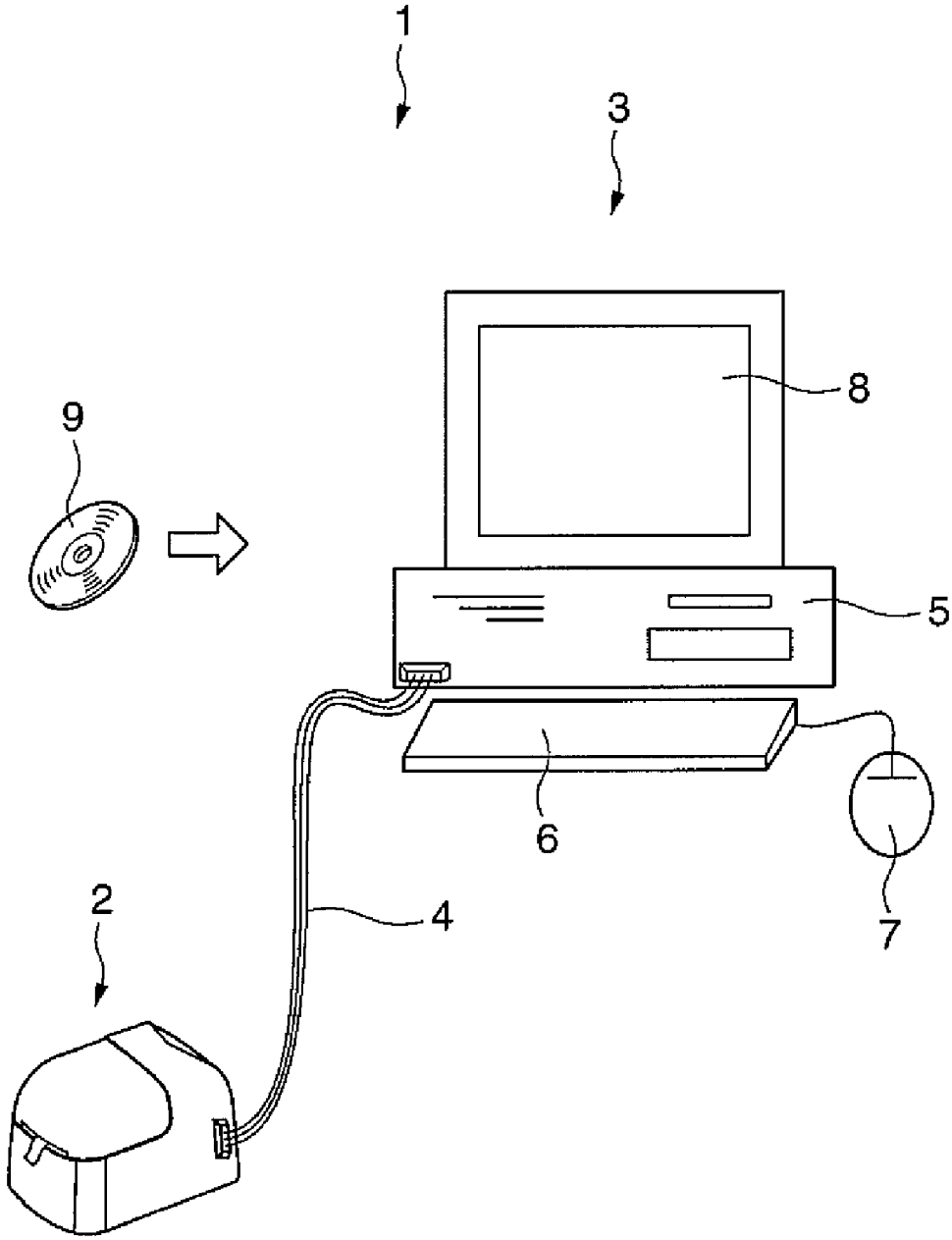
FIG. 1 is a schematic view of a sticky note printing system according to a first embodiment of the present invention.

As shown in FIG. 1, the sticky note printer 1 includes the sticky note printing device 2 in which a stacks of sticky note H is set and the PC (control unit) 3 which is connected to the sticky note printing device 2 through a USB cable (USB) 4 or the like. The PC 3 creates and edits printing data for performing printing on the sticky note H1 and controls various driving operations of the sticky note printing device 2.

The PC 3 has a PC main body 5, a keyboard 6, a mouse 7, and a display 8. The keyboard 6 and the mouse 7 are connected to the PC main body 5 so as to be used for data input, and the display 8 displays input results and the like. In the PC main body 5, a CD-ROM 9 is detachably set which stores application software (program) related to the sticky note printing device 2 and data such as device drivers. Further, when various detection signals, various instructions, and a variety of data are input from the keyboard 6 or the like, the PC 3 processes various data in accordance with the program within the CD-ROM 9 and controls the sticky note printing device 2.

Figure 2:
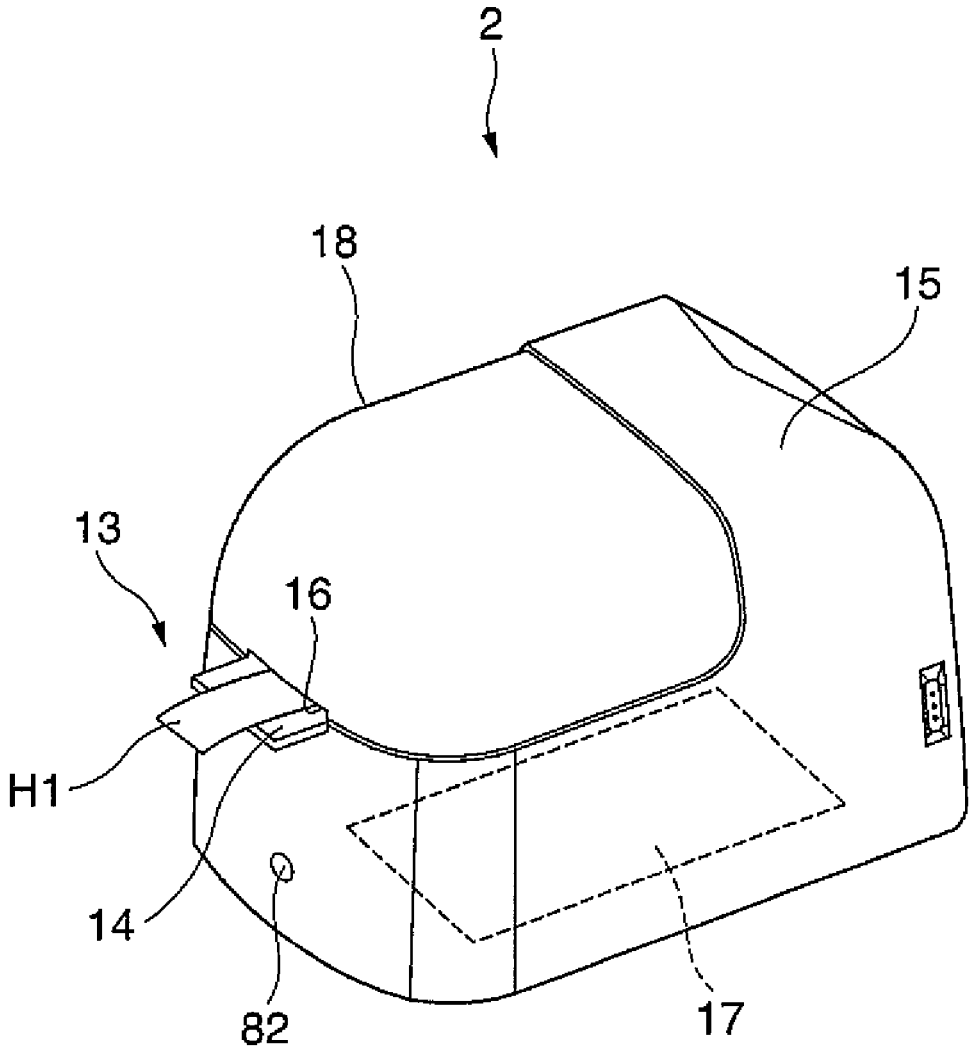
FIG. 2 is a perspective view illustrating the appearance of a sticky note printer according to the first embodiment.

As shown in FIG. 2, the sticky note printing device 2 has an outer shell formed of a device case 15. Inside the device case 15, a stacks of sticky note H is set. Further, the sticky note printing device 2 prints a desired character string on a sticky note Hi separated from the stack s of sticky note H set in the device case 15 one by one, the character string being created by the PC 3. The printed sticky note is discharged from a discharge section 13 formed in the device case 15.

The device case 15 is formed to have a small size as a whole and has a sticky note introduction opening 17 for introducing the stacks of sticky note H into the case, and the stick-note introduction opening 17 is formed on the bottom surface of the device case 15. The discharge section 13 has a horizontal-slit-shaped discharge slot 16 that is provided in the center of the front surface thereof and discharges the printed sticky note H1 to the outside of the device case 15 and a receiving section 14 that is provided around the discharge slot 16 and receives the separated printed sticky note H1. The receiving section 14 is horizontally provided so as to extend from the inside to the outside of the case on the basis of the discharge slot 16. In a portion of the receiving section 14 which is positioned inside the case, a detection opening 19 is formed so as to face a detecting sensor 24 which will be described. Further, on the to surface of the device case 15, a ribbon cartridge C accommodating an ink ribbon R is mounted, and an opening and closing lid 18 for maintenance is attached.

Figure 3:
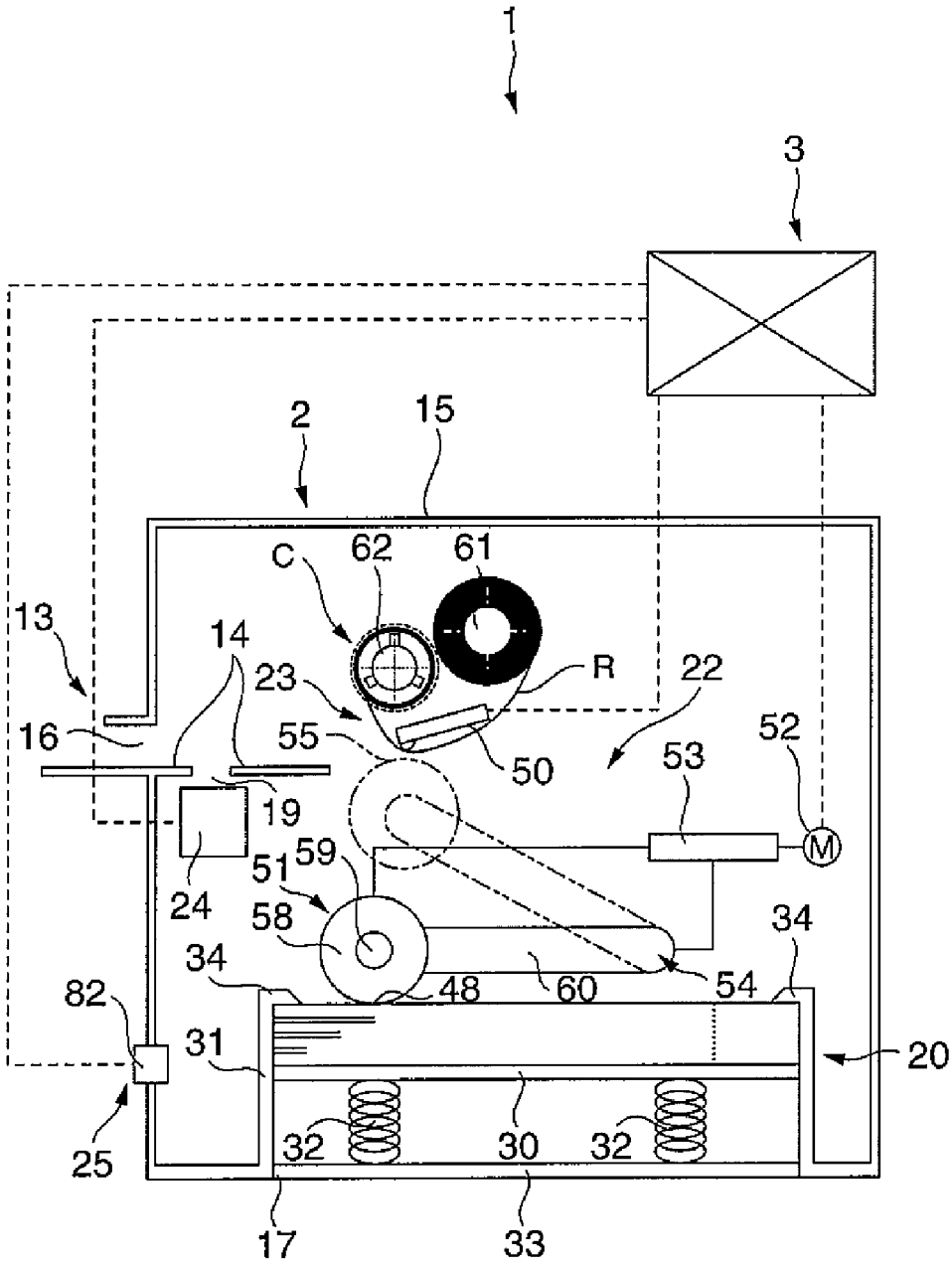
FIG. 3 is a schematic view illustrating the inner structure of the sticky note printer according to the first embodiment.

As shown in FIG. 3, the stacks of sticky note H is composed of a plurality of sticky note Hi of which the base end portions of the rear surfaces thereof are partially pasted. That is, the stacks of sticky note H is set by laminating the plurality of sticky note H1 having the same shape (rectangular shape) and the same size in a state where the base end portions of the rear surfaces thereof are partially pasted. The sticky note H1 can be separated from the stacks of sticky note H one by one. After being separated, the sticky note H1 can be attached to an object such as a datebook through a pasting portion (adhesive) of the base end portion thereof.

As shown in FIG. 3, the sticky note printing device 2 includes a sticky note holder 20 which sets the stacks of sticky note H, a transport unit 22 which rolls up the uppermost sticky note H1 of the stacks of sticky note H such that the sticky note H1 approaches an interposing position 55 to be described below and discharges the sticky note H1 to the outside of the device, a printing unit 23 which performs printing on the sticky note H1 located in the interposing position 55, a detecting sensor (detecting unit) 24 which is disposed in the vicinity of the discharge slot 16 inside the device case 15 so as to detect the presence of a sticky note H1, and an informing unit 25 which on the basis of the detection result of the detecting sensor 24, informs by using a lamp that the discharge of the sticky note H1 is poorly performed. The respective units are accommodated in the device case 15.

The sticky note holder 20 includes a set stage 30 formed in a box shape of which the upper surface is opened, an introduction guide 31 formed in a frame shape, and a lid body 33. The set stage 30 holds the stacks of sticky note H with a predetermined size and loads the stacks of sticky note H in the horizontal direction. The introduction guide 31 guides the set stage 30 so as to vertically slide. The lid body 33 supports the set stage 30 from the bottom side thereof with a plurality of coil springs 32 interposed therebetween and opens and closes the sticky note introduction opening 17. Further, the introduction guide 31 has a pair of position regulating sections 34 formed in both upper ends so as to project inward. The pair of position regulating sections 34 relatively holds down the free end portion and pasting portion of the stacks of sticky note H, respectively. The set stage 30 is biased upward by the plurality of coil springs 32. The stacks of sticky note H is supported by the set stage 30 such that the sticky note H1 positioned in the uppermost position is maintained at a constant height level even though the sticky note H1 are discharged one by one.

The sticky note holder 20 is detachable with respect to the device case 15 such that the lid body 33 is retained in a snap-in manner. That is, when the stacks of sticky note H is set in the sticky note holder 20, the sticky note holder 20 is removed from the inside of the device case 15. Then, the stacks of sticky note H is put into the sticky note holder 20, and the sticky note holder 20 is again mounted into the device case 15. In this state, the lower surface of the lid body 33 and the lower surface of the device case 15 are positioned on the same plane such that the sticky note introduction opening 17 is closed. Moreover, the sticky note holder 20 may be mounted into the device case 15 in a cassette manner. That is, the sticky note holder 20 is constructed to have a sticky note-stack case formed in a box shape, of which the upper surface is opened, and a set stage accommodated in the sticky note-stack case with a plurality of coil springs interposed therebetween. Further, when the setting the stacks of sticky note H is performed, the sticky note holder 20 is removed from the inside of the device case 15, and the sticky notes are set in the sticky note holder 20.

The transport unit 22 is constructed to roll up the uppermost sticky note H1 of the stacks of sticky note which approaches a pickup position 48. The transport unit 22 includes a feed roller 51, a driving motor 52, a decelerating gear train 53, and a roller moving unit 54. The feed roller 51 comes in rolling contact with the uppermost sticky note H1 to roll up and rotationally feeds the rolled-up sticky note H1 in a state where the sticky note H1 is interposed between the feed roller 51 and a thermal head 50 to be described below. The driving motor 52 serves as a driving source of the feed roller 51. The decelerating gear train 53 transmits a driving force of the driving motor 52 to the feed roller 51. The roller moving unit 54 moves the feed roller 51 to a position between the pickup position 48 where the sticky note H1 is rolled up and the interposing position 55 where the sticky note H1 is interposed between the feed roller 51 and the thermal head 50.

The feed roller 51 comes in rolling contact with the free end side of the rolled-up sticky note H1 and rotationally feeds the sticky note H1 in the interposing position 55 while separating the sticky note H1. The feed roller 51 includes a roller main body 58 which directly comes in rolling contact with the sticky note H1 and a roller driving shaft 59 serving as a rotating shaft of the roller main body 58. Both end portions of the roller driving shaft 59 are rotatably held by the roller moving unit 54 such that the roller driving shaft 59 is rotated by the power of the driving motor 52 which is transmitted through the decelerating gear train 53. Further, the feed roller 51 has functions as follows. The feed roller 51 comes in rolling contact with the sticky note H1 to roll up and serves as a platen roller cooperating with the thermal head 50.

The roller moving unit 54 has a pair of swing arms 60 of which the front end portion rotatably holds the roller driving shaft 59. The pair of swing arms 60 are constructed so as to swing around the base end portion thereof. For example, one of the swing arms 60 is set to a carrier. Further, the roller moving unit 54 includes a planetary gear mechanism using some gears forming the decelerating gear train 53 and a cam mechanism converting a rotational force of the gear into the swing operation of the swing arms 60. That is, the circular motion caused by the planetary gear mechanism is converted into the reciprocating swing motion of the swing arms 60 by the cam mechanism. The reciprocating swing motion of the swing arms 60 allows the feed roller 51 to move between the pickup position 48 and the interposing position 55 while the feed roller 51 rotates.

The printing unit 23 has the thermal head 50, which is disposed in the vicinity of the discharge slot 16 and is formed to have substantially the same width as the feed roller 51, and a ribbon winding mechanism (not shown) which winds the ink ribbon R of the mounted ribbon cartridge C. The ribbon cartridge C is composed of a ribbon feed reel 61 around which the ink ribbon R is wound so as to be fed, a ribbon winding reel 62 which winds the ink ribbon R, and a cartridge case (not shown) which rotatably accommodates the reels. Further, when the feed roller 51 moves to the interposing position 55, the ribbon winding mechanism is connected to the decelerating gear train 53 so as to receive power from the driving motor 52. Then, the ribbon winding mechanism starts to wind (feed) the ink ribbon R while the sticky note H1 is fed.

In accordance with a control signal from the PC 3, the printing unit 23 having the above-described structure performs printing on the sticky note H1 while the thermal head 50 and the driving motor 52 are controlled. That is, the sticky note H1 and the ink ribbon R are interposed between the feed roller 51 moved to the interposing position 55 and the thermal head 50. Then, while the sticky note H1 and the ink ribbon R are fed side by side, printing is performed on the surface of the sticky note H1 by a heating operation of the thermal head 50.

The detecting sensor 24 is disposed in the downstream side of the feed direction with respect to the feed roller 51 which has moved upward to the interposing position 55, that is, between the feed roller 51 and the discharge slot 16. Further, the detecting sensor 24 is disposed to face the detection port 19 formed in the receiving section 14. Although the details are not shown, the detecting sensor 24 is composed of a transmitting or reflecting optical sensor which detects the presence of the sticky note H1.

The detection signal of the detecting sensor 24 is input to the PC 3. On the basis of the detection result, the PC 3 controls the drive of the transport unit 22 and the printing unit 23. That is, when the next sticky note H1 starts to be transported after a sticky note H1 is completely transported by the transport unit 22, and when the detecting sensor 24 detects the 'presence', the PC 3 controls the transport unit 22 and the printing unit 23 such that the transport unit 22 and the printing unit 23 are prohibited from being driven. That is, at the time when the next sticky note H1 is transported, the PC 3 determines that the sticky note H1 is not removed from the discharge slot 16, and then prevents the transport unit 22 and the printing unit 23 from being driven.

The informing unit 25 is a display lamp (defective discharge informing unit) 82 provided on the front surface of the device case 15. The PC 3 turns on or off the display lamp 82 in accordance with the detection result of the detecting sensor 24. Specifically, when the next sticky note H1 starts to be transported after a sticky note H1 is completely transported by the transport unit 22, and when the detecting sensor 24 detects the 'presence', the display lamp 82 is turned on. Otherwise, the display lamp 82 is turned off. As for the display lamp 82, two lamps (red lamp and blue lamp) are provided. Immediately after the sticky note H1 is completely transported, the blue lamp may be turned on so as to urge a user to remove the sticky note H1. When the sticky note H1 starts to be transported, the red lamp may be turned on to notice that the sticky note H1 needs to be removed. Further, the display lamp 82 may flicker so as to urge a user to remove the sticky note H1, and the display lamp 82 may be turned on to notice that the sticky note H1 needs to be removed.

Hereinafter, referring to FIGS. 4A to 4G, a series of operations from the rolling up to the discharge of the sticky note H1 will be described. In a printing wait state, the feed roller 51 is located in the pickup position 48 and comes in rolling contact with the surface of the uppermost sticky note H1 of the stacks of the sticky note H set in the sticky note holder 20 (see FIG. 4A).

When a user instructs to perform printing by using the PC 3, the feed roller 51 starts to rotate and roll up the sticky note H1. That is, as the feed roller 51 comes in rolling contact with the free end side of the uppermost sticky note H1, the sticky note H1 is deflected such that the middle portion thereof in the longitudinal direction is curved upward (see FIG. 4B).

Immediately after the leading end of the rolled-up sticky note H1 passes through the lower side of the feed roller 51, the feed roller 51 moves upward so as to be separated from the stacks of the sticky note H while rotating. Then, the sticky note H1 jumps up to the upper side of the feed roller 51 due to the rotational force of the feed roller 51 such that the feed end side thereof rides on the feed roller 51 (see FIG. 4C).

Figure 4A:
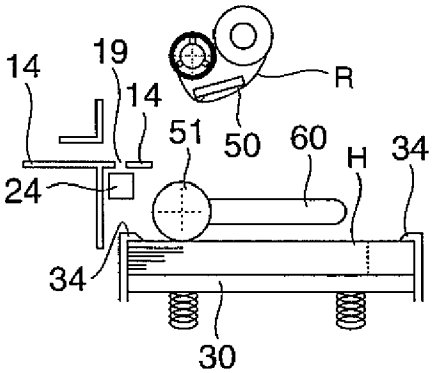
FIGS. 4A to 4G are diagrams showing a series of operations of the sticky note printer.
Figure 4B:
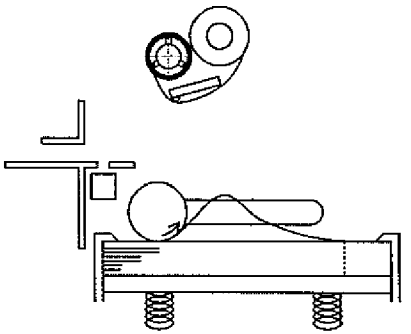
Figure 4C:
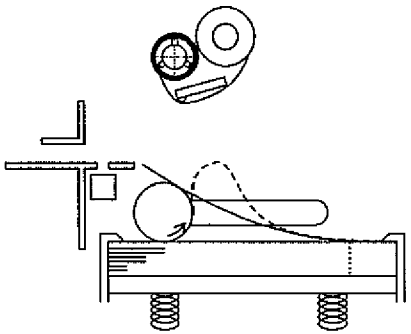
Figure 4D:
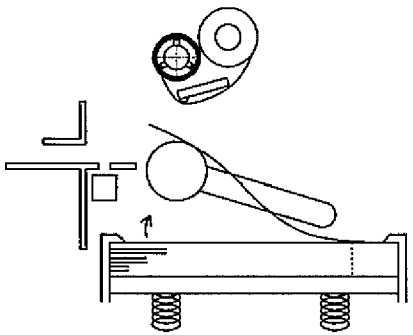
Figure 4E:
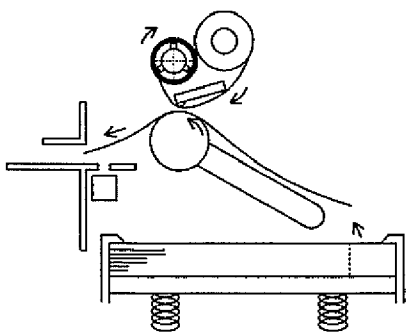
Figure 4F:
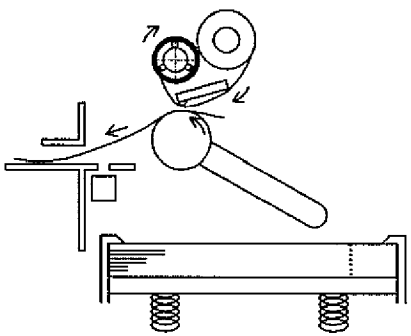

The feed roller 51 having the sticky note H1 loaded thereon continuously moves (revolves) to the interposing position 55 while rotating (see FIG. 4D). When the feed roller 51 reaches the interposing position 55 such that the sticky note H1 is interposed between the thermal head 50 and the feed roller 51, the ink ribbon R starts to be fed (see FIG. 4E).

At the same time when the feed roller 51 comes in rolling contact with the rear surface of the sticky note H1, separates the sticky note H1 from the stacks of sticky note H, and rotationally feeds the sticky note H1 toward the discharge slot 16 with the feed end side thereof set to the front side, the free roller 51 serves as a platen roller. That is, while a pasting portion of the sticky note H1 is separated, the thermal head 50 and the feed roller 51 cooperate to perform printing on the surface of the sticky note H1 from the free end side thereof.

Figure 4G:
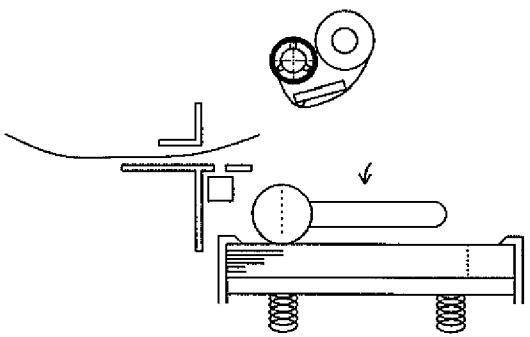

Further, when the pasting portion of the sticky note H1 reaches the feed roller 51 (see FIG. 4F), the feed roller 51 moves to the pickup position 48 from the interposing position 55, and the printed sticky note H1 is delivered to the receiving section 14 of the discharge slot 16 (see FIG. 4G). At this time, the detecting sensor 24 detects the 'presence' of the sticky note H1, and the display lamp 82 is turned on to remind a user to remove the printed sticky note H1.

While the detection result of the detecting sensor 24 is still the 'presence', that is, when the sticky note H1 is not removed by a user, the PC 3 prohibits the driving motor 52 and the thermal head 50 from being driven, even though an instruction to perform the next printing is made. Meanwhile, as a user removes the sticky note H1, the detection result of the detecting sensor 24 becomes the 'non-presence'. Then, the PC 3 releases the driving prohibition of the driving motor 52 and the thermal head 50 such that the device is set in the printing wait state.

According to the above-described structure, although the sticky note H1 is attached to the receiving section 14 of the discharge slot 16 after the printing is completed, the transport unit 22 is prohibited from being driven so that the next sticky note H1 is not fed. Therefore, it is possible to reliably prevent a paper jam. In this embodiment, although the sticky note supply device is applied to the sticky note printer 1, the sticky note printing device 2 may be provided with a function of creating/editing printing data or a function of controlling the respective units such that printing is performed on the sticky note H1 by using the sticky note printing device 2 as a single body.

Figure 5:
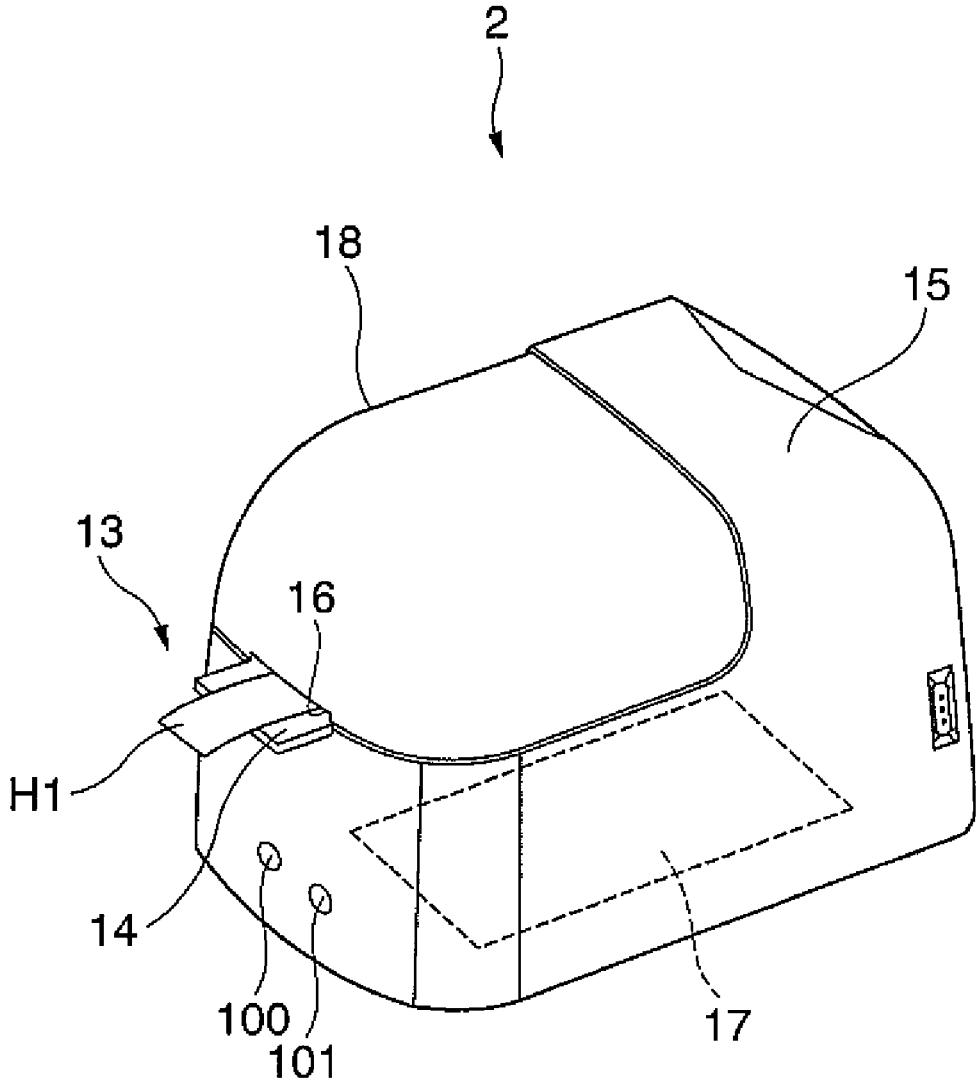
FIG. 5 is a perspective view illustrating the appearance of a sticky note printer according to a second embodiment.

Referring to FIG. 5, a sticky note printer 1 according to a second embodiment of the invention will be described. The descriptions of the same components as those of the first embodiment will be omitted, and the descriptions of different components will be only described. In the sticky note printer 1, when the next sticky note H1 starts to be transported after a sticky note H1 is completely transported by the transport unit 22, a counting program (counting unit), which counts every time transport is completed, stores the 'presence' detection of the detecting sensor 24 into the CD-ROM 9. The PC 3 executes this counting program so as to prohibit the transport unit 22 and the printing unit 23 from being driven when the counted number exceeds a predetermined number. Further, the informing unit 25 includes a transport completion display lamp (transport completion noticing unit) 100 which informs the completion of transport and a defective discharge display lamp (defective discharge noticing unit) 101 which notices that the discharge is poorly performed. In this case, it is preferable that the transport completion display lamp 82 be set to a blue lamp and the defective discharge display lamp 82 be set to a red lamp, similar to the first embodiment. Moreover, the informing unit 25 may be constructed so as to give an alarm by using a voice.

When the printed sticky note H1 is delivered to the receiving section 14 of the discharge slot 16, the detecting sensor 24 detects the 'presence' of the sticky note H1, and the 'presence' detection is counted by the counting program. Further, on the basis of the 'presence' detection, the PC turns on the transport completion display lamp 82 so as to remind a user to remove the printed sticky note H1. In a state where the sticky note H1 is not removed by a user, the next sticky note H1 is printed and is then delivered to the receiving section 14 of the discharge slot 16. Then, the detecting sensor 24 again detects the 'presence' of the sticky note H1, and the detection is counted by the counting program. If the counted number exceeds a predetermined number, the PC 3 prohibits the driving motor 52 and the thermal head 50 from being driven and turns on the defective discharge display lamp 82 (or turns on the defective discharge display lamp 82 after turning off the transport completion display lamp 82) so as to inform the user that the discharge is poorly performed. Meanwhile, when the user removes the sticky note H1 such that the detecting sensor 24 detects the 'non-presence', the counted number is reset, and the PC 3 releases the driving prohibition of the driving motor 52 and the thermal head 50. Then, the device is set in the printing wait state.

According to the above-described structure, when the counted number exceeds a predetermined number, the next sticky note H1 is prevented from being fed. Therefore, it is possible to prevent a paper jam. Meanwhile, when the counted number is within a predetermined number, the discharge of the sticky note H1 is permitted. Therefore, a sticky note H1 to be discharged in sequence does not need to be prohibited from being transported in each case. In this embodiment, even when two to four sheets of sticky note H1 are discharged, a paper jam is unlikely to occur. Therefore, the prescribed counting number is set to three to five.

What is claimed is:

1. A sticky note supply device which separates an uppermost sticky note from a stack of sticky notes one by one so as to discharge to the outside of the device from a discharge section, the sticky note supply device comprising:

a transport unit that separates the uppermost sticky note to drive and discharge the uppermost sticky note to the outside of the device from the discharge section;

a control unit that controls the drive of the transport unit; and a detecting unit that is provided in the discharge section so as to detect whether the uppermost sticky note is present or not, wherein when a next sticky note starts to be transported after the uppermost sticky note is completely transported by the transport unit and the detecting unit detects a presence of the uppermost sticky note transported by the transported unit, the control unit prohibits the transport unit from being driven until the presence of the uppermost sticky note transported by the transport unit is no longer detected.

2. The sticky note supply device according to claim 1, further comprising:

a defective discharge informing unit that informs that defective discharge is performed, when the next sticky note starts to be transported after the sticky note is completely transported and the detecting unit detects the presence.

3. A sticky note printer comprising:

the sticky note supply device according to claim 1; and a printing unit that performs printing on a sticky note transported by the transport unit.

4. A sticky note supply device which separates an uppermost sticky note from a stack of sticky notes one by one so as to discharge to the outside of the device from a discharge section, the sticky note supply device comprising:

a transport unit that separates the uppermost sticky note to drive and discharge the uppermost sticky note to the outside of the device from the discharge section;

a control unit that controls a drive of the transport unit;

a detecting unit that is provided in the discharge section so as to detect whether the uppermost sticky note is present or not; and a counting unit that counts as a counted number a presence detection of the uppermost sticky note of the detecting unit transported by the transport unit every time transport is completed, when a next sticky note starts to be transported after the uppermost sticky note is completely transported by the transport unit, wherein when the counted number by the counting unit exceeds a predetermined number, the control unit prohibits the transport unit from being driven.

5. The sticky note supply device according to claim 4, further comprising:

a discharge completion informing unit that informs the completion of discharge, when the detecting unit detects the presence after the sticky note is completely transported.

6. The sticky note supply device according to claim 4, further comprising a defective discharge informing unit that informs that defective discharge is performed, when the counted number by the counting unit exceeds a predetermined number.

* * * * *